United States Patent [19]

Grosser et al.

[11] 3,945,160

[45] Mar. 23, 1976

[54] BUILDING STRUCTURES

[75] Inventors: Christian E. Grosser, Richmond; Jack M. Roehm, Virginia Beach, both of Va.

[73] Assignee: Grosser Enclosures Company, Richmond, Va.

[22] Filed: Nov. 6, 1974

[21] Appl. No.: 521,458

[52] U.S. Cl. ..... 52/81; 52/82

[51] Int. Cl.[2] ..... E04B 1/34; E04B 7/08

[58] Field of Search ..... 52/80, 88, DIG. 10, 81, 52/86, 82, 90

[56] References Cited

UNITED STATES PATENTS

| | | | |
|---|---|---|---|
| 2,918,992 | 12/1959 | Gelsavage | 52/81 |
| 3,203,144 | 8/1965 | Fuller | 52/81 |
| 3,445,970 | 5/1969 | Nelson | 52/81 |

FOREIGN PATENTS OR APPLICATIONS

| | | | |
|---|---|---|---|
| 1,133,581 | 3/1957 | France | 52/10 |

*Primary Examiner*—John E. Murtagh

*Attorney, Agent, or Firm*—Strauch, Nolan, Neale, Nies & Kurz

[57] ABSTRACT

Panel constructions which can be assembled into building structures of various sizes, shapes, and types; systems for attaching the panels to each other; and building structures of panel-type construction.

6 Claims, 22 Drawing Figures

BUILDING STRUCTURES

This invention relates in one aspect to novel, improved, self-supporting building structures which can be readily constructed at modest cost and in various shapes and sizes from small assortments of relatively simple, standardized, panel-type components.

In another aspect our invention relates to novel, improved panels from which building structures as described in the preceding paragraph can be fabricated and to novel, improved systems for fastening the panels together and for sealing the joints therebetween.

Our novel building structures are made up primarily of novel edge-abutted, triangular panels which can be produced with accurate dimensions at relatively low cost although they may include panels of other polygonal configurations as well as components made by other techniques including those of conventional nature.

The three-sided panels making up our novel building structures may, in plan, have the shape of isosceles, equilateral, and right triangles. Such panels will hereinafter be respectively referred to as isosceles triangle panels, equilateral triangle panels, and right triangle panels.

Also, we will on occasion refer to dimensionally alike panels. By this we mean panels which have edges or sides of the same length and the same angles between corresponding edges. 31,

The use of triangular and other polygonal panels as building components is in itself a known concept as shown by U.S. Pat. Nos. 2,440,449 issued Apr, 27, 1948; 2,682,235 issued June 29, 1954; 2,711,181 issued June 21, 1955; 2,918,992 issued Dec. 29, 1959; 3,061,997 issued Nov. 6, 1962; 3,094,708 issued June 25, 1963; 3,114,176 issued Dec. 17, 1963; 3,137,371 issued June 16, 1964; 3,192,669 issued July 6, 1965; 3,203,144 issued Aug. 31, 1965; 3,344,565 issued Oct. 3, 1967; 3,359,694 issued Dec. 26, 1967; 3,530,621 issued Sept. 29, 1970; 3,557,501 issued Jan. 26, 1971; and 3,640,034 issued Feb. 8, 1972.

Our novel building structures, however, are different from and have a number of important advantages over those heretofore proposed.

One is that they can be fabricated from fewer types of panels than have previously been required in many cases. A related advantage is that, although only a limited variety of panels is employed, they are so designed that they can be assembled into structures of different sizes and shapes and even into self-supporting structures useful as or in roofs for building structures constructed by other techniques.

Another advantage of our invention is that we can provide building structures which are rectangular in plan. This is unusual in panel-type construction and important; it simplifies the construction of foundations, increases compatibility with conventional wall structures, and makes the most efficient use of the area occupied by the structure.

Another advantage of our novel building structures is that they can be erected with a minimum of labor. Also, erection is sufficiently simple that expertise is not required.

In addition, individual panels can be readily removed from the structures into which they are assembled. This is important from the maintenance point-of-view.

Furthermore, our novel panel construction readily lends itself to partial pre-fabrication. In many applications erection costs can be reduced by assembling at least part of the panels into sections before they reach the erection site.

In addition our novel building structures can in most cases be made to withstand whatever snow and wind loads may be required simply by minor modifications in the dimensions of the panels from which they are fabricated. The importance of this feature is self-evident.

Also, the problems of introducing service facilities into our novel building structures are minimal because this can be done at virtually any joint. A related advantage is that certain of our novel panels have frames with passages suitable for housing electrical, plumbing, and other services.

This type of panel consists of a main member of relatively large area. This member is surrounded by a frame composed of two members with the main panel member and a compressible seal confined therebetween. The frame members are of readily extrudable configurations and also of configurations which permit one member to be displaced with respect to the other to adjust the clamping force on the main panel member and the compressible seal. Both of these features are important, the first from the cost point-of-view and the second because it permits an effective seal between the main panel member and the frame to be easily achieved.

Another advantage of the novel frame members just described is that they can readily be provided with integral ancillary components such as gutters for collecting and draining off condensate, for example.

Another advantage of these novel panels is that the frames are torsionally rigid unlike many previously employed panels which are free to rack or twist. Torsional rigidity permits the main panel member to be made of relatively fragile and brittle materials such as glass and acrylic plastics. This is important in applications where a panel capable of transmitting light is wanted.

As mentioned above, the panels we employ are typically of triangular configuration. The frames are made in three sections, and the ends of the sections are mitered at the corners of the panel. An important advantage of this arrangement is that the frame sections can be secured together by simple, flanged, triangular, sheet metal clips, a technique which is both effective and inexpensive.

Panels of the character just described can be secured to adjacent panels in the edge abutted relationship we employ by bolting together the frame members of adjacent panels. This erection technique is both simple and inexpensive.

A related and novel feature of our invention is the provision of wedges which can be inserted between adjacent frame members to span the gap therebetween which will exist at certain of the dihedral angles at which adjoining panels may meet. This makes the joint rigid which is of obvious importance.

Those frame members which are intended to be assembled to those of adjoining panels preferably have a V-like face configuration which accommodates variations in dihedral angle. Facing recesses near the apices of the V-shaped faces support compressible seals which span the two frame members and seal the gap therebetween. Location of the seals as just described is important because it makes the effectiveness of the seal independent of the dihedral angle between the panels.

At those locations where corners or apices of the panels meet, an effective seal can be provided by securing a washer-like seal in place with a self-tapping fastener. Again, the technique is simple and effective.

Another novel type of panel embodying the principles of the present invention consists of a main member with a flexible seal extending continuously around its periphery. These panels have the advantages of maximum simplicity and low cost.

Panels of this type are fixed in edge abutting relationship with the seals of adjoining panels closing the gap therebetween by connectors at the locations where the corners of the panels meet, which also seal any gaps existing at such locations, and tension members extending between adjacent pairs of connectors. Virtues of this system are simplicity and ease of erection. Also because there are no metal frame members and because the main panel members will tend to be somewhat thicker, this construction will often have a greater heat insulating effect than other types of structures.

We prefer, in employing this type of construction, to make the connection between one (or both) ends of each tension member and the associated connector through a constant force spring device. This is a simple and effective technique for accommodating the thermal expansion and contraction which occurs as the ambient temperature changes. Also, the use of a constant force spring device reduces erection costs by making it possible to easily provide the wanted stress in the tension members.

Techniques for assembling panels in edge abutting relationship have of course been proposed and are shown, for example, in U.S. Pat. Nos. 1,970,404 issued Aug. 14, 1934; 2,085,281 issued June 29, 1937; 2,278,956 issued Apr. 7, 1942; 2,343,764 issued Mar. 7, 1944; 2,668,509 issued Feb. 9, 1954; 2,881,717 issued Apr. 14, 1959; 3,014,558 issued Dec. 26, 1961; 3,090,162 issued May 21, 1963; 3,139,958 issued July 7, 1964; 3,206,895 issued Sept. 21, 1965; 3,550,335 issued Dec. 29, 1970; and 3,660,952 issued May 9, 1972; in Canadian Pat. No. 670,583 issued Sept. 17, 1963; and in British Pat. Specification No. 1,002,301 published Aug. 25, 1965. Clips for securing frame members together have heretofore been proposed as shown by U.S. Pat. No. 547,585 issued Oct. 8, 1895. Nevertheless, none of the above-listed patents nor any others of which we are aware disclose panel constructions or assembly techniques therefore having the advantages of those we employ as discussed above.

The applications of our invention are virtually limitless. Building structures fabricated in accord with its principles can be employed to enclose swimming pools, tennis courts, and other areas, for storage, and for many other purposes. The structures can be so constructed as to completely enclose the covered area or to be partly open; and access to the interior of the structure can easily be provided.

From the foregoing it will be apparent to the reader that one important and primary object of our invention resides in the provision of novel, improved, self-supporting building structures which can be employed alone or in conjunction with structures of different character to completely or partially enclose selected objects and/or areas.

Other important but more specific objects of the invention reside in the provision of self-supporting building structures in accord with the preceding object:

1. which can be assembled from a limited number of standardized components;

2. which are rectangular in plan;

3. which can be erected with a minimum of labor and without the exercise of special skills;

4. which can be made to withstand such wind and snow loads as may be necessary with a minimum of design change;

5. which facilitate the provision of electrical, telephone, plumbing, and other service facilities;

6. which can be provided at costs significantly lower than those of comparable structures of conventional construction;

7. with individual panels which can be readily removed when necessary for repair or maintenance.

A second important and primary object of the present invention resides in the provision of novel, improved panel constructions from which building structures can be erected.

Related and important but more specific objects of our invention reside in providing panel constructions in accord with the preceding object:

9. which are capable of being mass produced to accurate dimensions;

10. which can be assembled into sections prior to erection of the building in which they are incorporated to thereby expedite the on-site erection process;

11. which are simple;

12. which can be produced at a relatively low cost;

13. which, in conjunction with the preceding object, employ frame members of readily extrudable configurations;

14. which, in conjunction with object 12, consist of a main member and a compressible peripheral seal;

15. which can be easily assembled;

16. which have a highly effective seal between a main member and a frame extending around and supporting the main member;

17. which have a torsionally rigid peripheral frame construction, permitting the main member of the panel to be made from a relatively fragile and/or brittle material;

18. which have integral gutters for carrying condensed moisture away;

19. which have a main member surrounded by plural frame sections and simple frictional retainers for securing the frame sections together.

Yet another important and primary object of the present invention resides in the provision of novel, improved systems for securing panel constructions together in edge abutting relationship to form a variety of building structures.

Related important but more specifc objects of the invention include systems in accord with the preceding object:

20. which permit adjoining panels to be secured together in a manner which will result in a solid joint therebetween independently of the angle of dihedral between the panels;

21. which permit adjoining panels to simply be bolted together;

22. which afford effective sealing between the abutted edges of adjoining panels and at those locations where the corners of panels meet;

23. which effectively accommodate thermal expansion and contraction of the assembled panels.

24. which, in conjunction with the preceding object, include connectors clamping the panels together at locations where their corners meet, tension members extending between adjacent connectors, and constant force spring devices for keeping the tension in said members constant as the panels expand and contract.

Other important objects and features and additional advantages of our invention will become apparent from the appended claims and as the ensuing detailed description and discussion proceeds in conjunction with the accompanying drawing in which:

Figure 7:
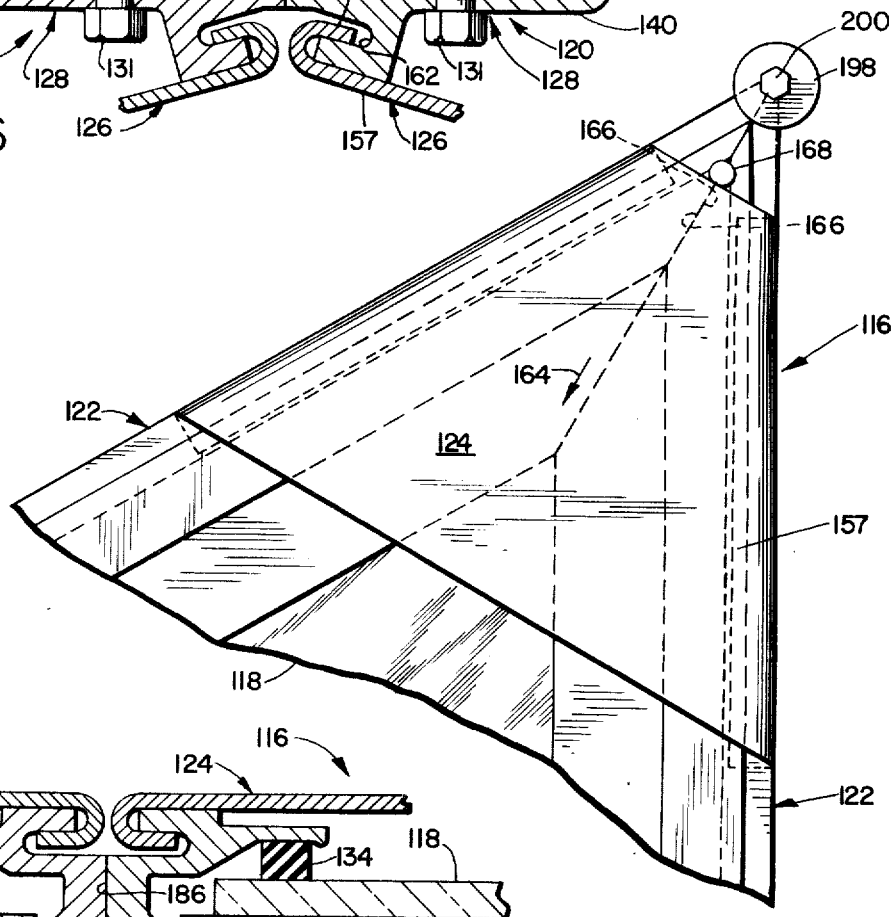
FIG. 7 is a partial plan view of a panel as shown in FIG. 6.
Figure 8:
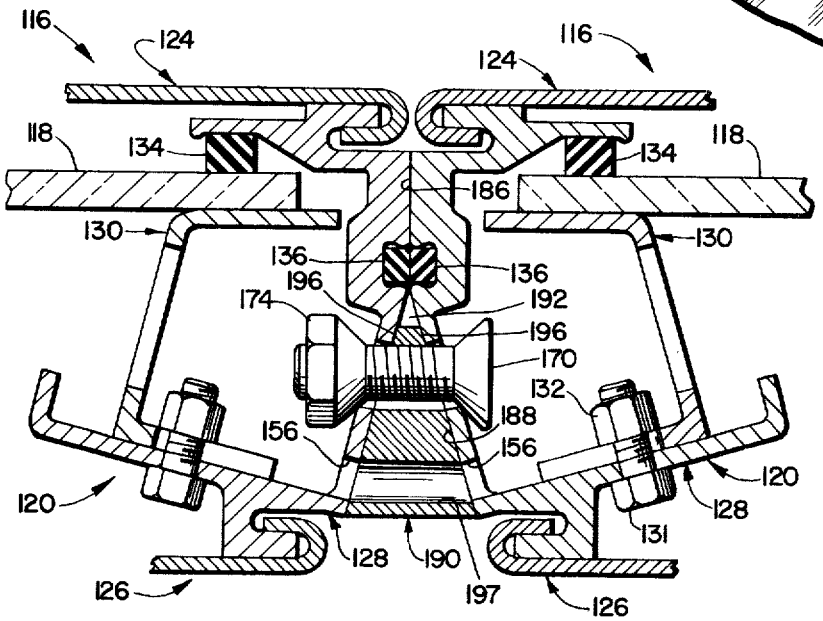
FIG. 8 is a view similar to FIG. 6 showing the novel technique we employ for accommodating variations in dihedral angle between adjoining panels.
Figure 9:
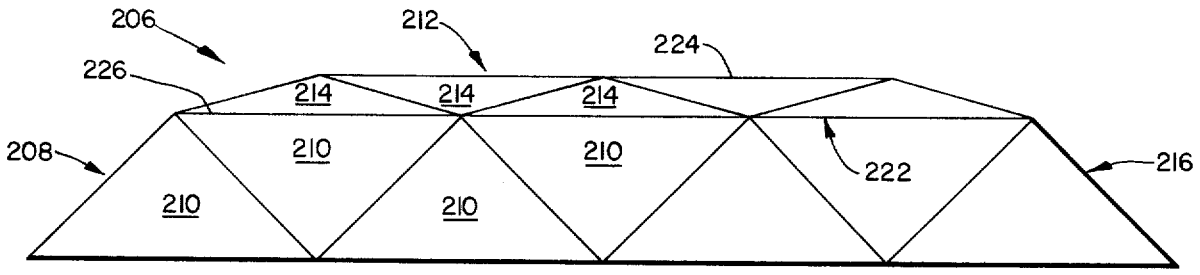
FIG. 9 is a side elevation of another form of space enclosing structure in accord with the principles of the present invention.
Figure 12:
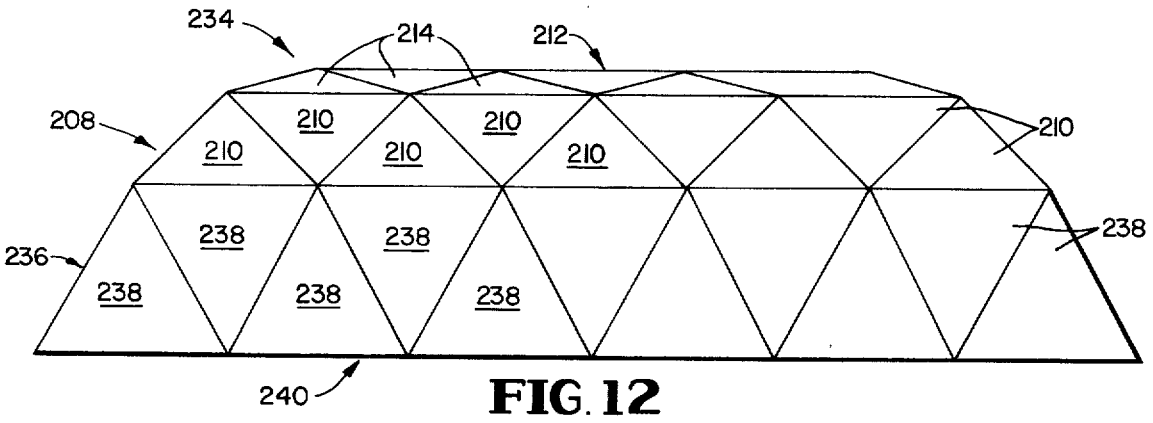
Figure 13:
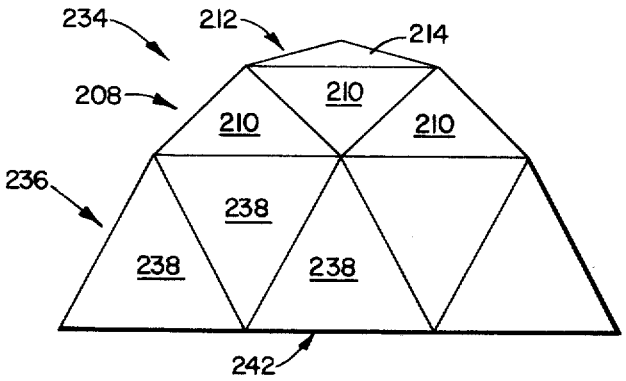
Figure 14:
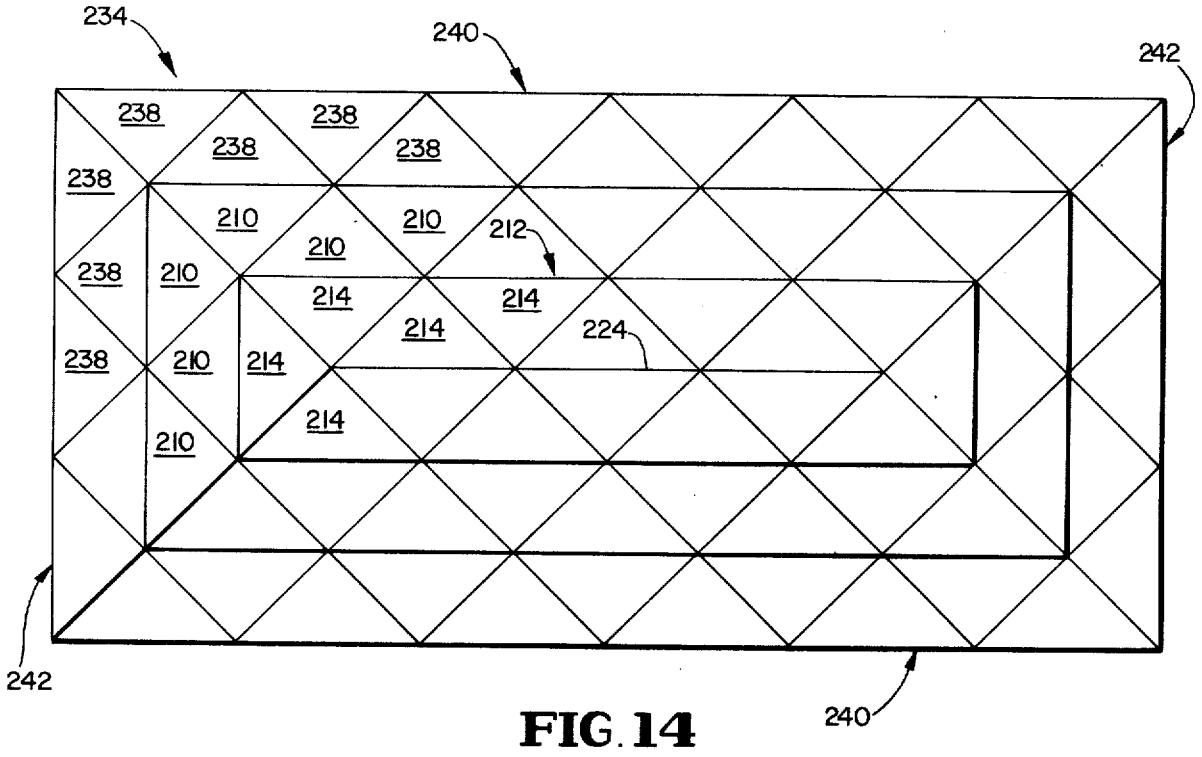
Figure 20:
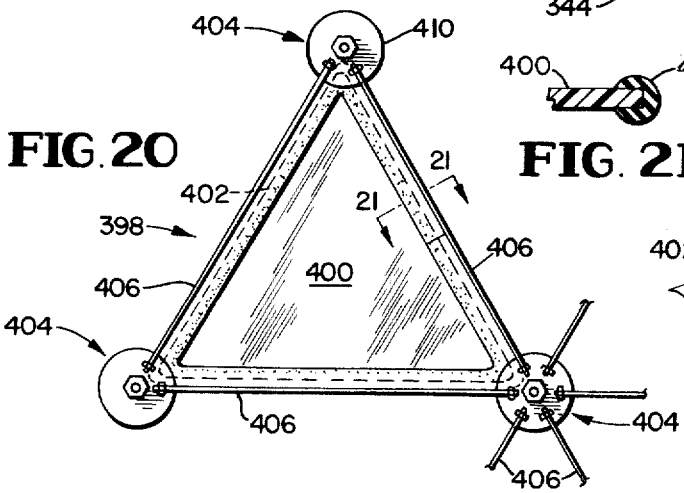
Figure 21:
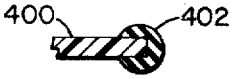
Figure 22:
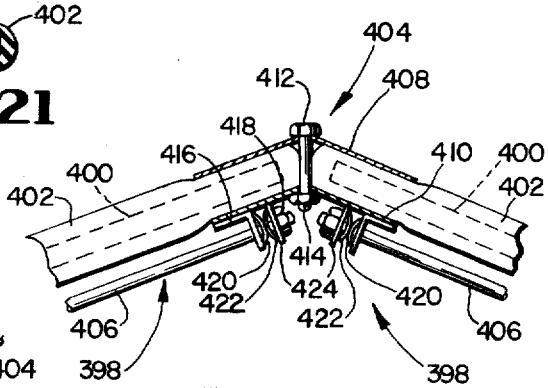

FIGS. 12, 13, and 14 are views similar to FIGS. 7, 8, and 9, respectively, of a further embodiment of space enclosing structure constructed in accord with the principles of the present invention;

FIGS. 15–19 are pictorial views of still further embodiments of our invention;

FIG. 20 is a partially schematic view of a second form of panel embodying the principles of the present invention and of the novel system we employ for assembling such panels;

FIG. 21 is a section through the panel of FIG. 20 taken substantially along line 21—21 of FIG. 20; and FIG. 22 is a partial section through two adjoining panels of the type illustrated in FIG. 20; it also shows additional details of the technique we employ for assembling the panels.

Figure 1:
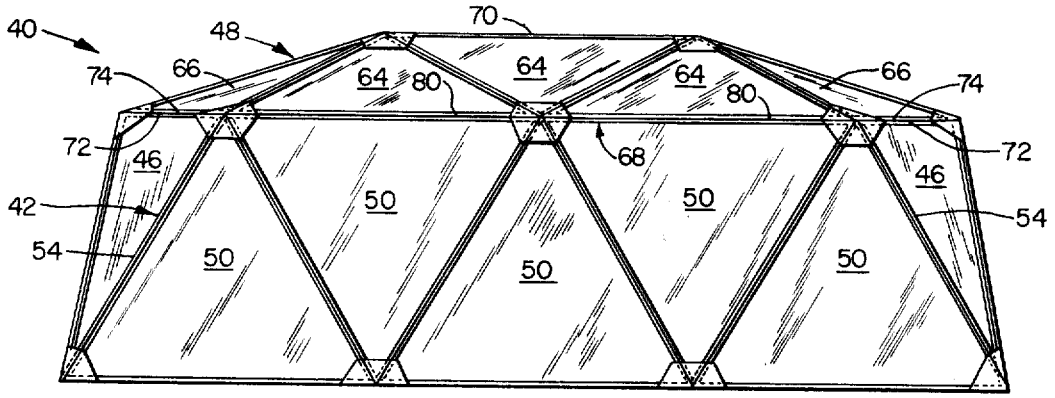
FIG. 1 is a side elevation of one space enclosing structure embodying and constructed in accord with the principles of the present invention.
Figure 2:
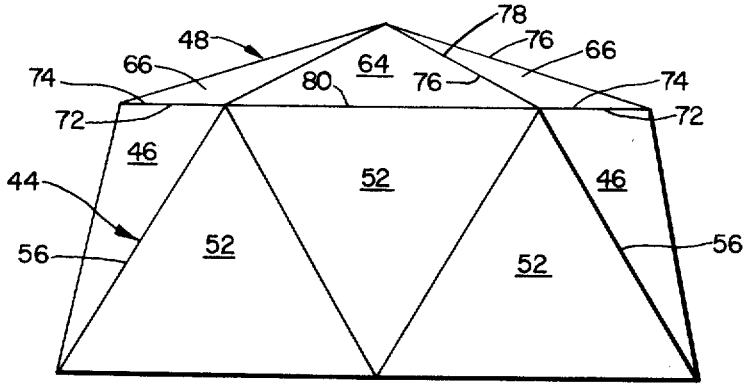
FIG. 2 is an end elevation of the structure of FIG. 1.
Figure 3:
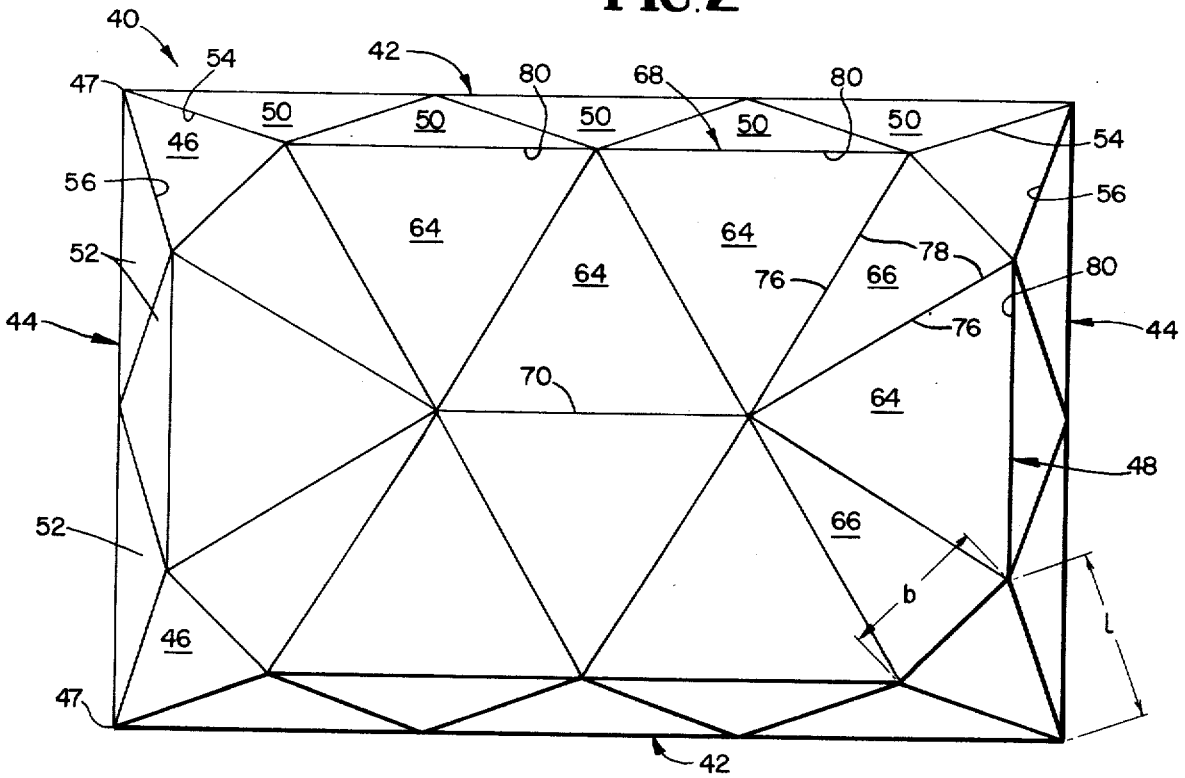
FIG. 3 is a plan view of the structure.

Referring now to the drawing, FIGS. 1–3 depict schematically a self-supporting space enclosing structure 40 constructed in accord with and embodying the principles of the present invention. Structure 40 has trapezoidal side and end walls 42 and 44 which meet at right angles at their lower edges (see FIG. 3), isosceles triangle corner panels 46 which span the gaps between the side walls 42 and end walls 44 at the four corners 47 of structure 40, and a cover or roof structure 48 which is vertically superimposed upon and supported by side and end walls 42 and 44.

Each of the two side walls 42 is made up of dimensionally alike equilateral triangle panels 50 disposed in edge abutted relationship with alternate panels inverted so that the side walls have continuous upper and lower edges. The two end walls 44 are made up of similarly arranged equilateral triangle panels 52 which are dimensionally like those in side walls 42.

Isosceles triangle panels 46 span the gap between and are disposed in edge abutting relationshp with a side edge 54 of a panel 50 in a side wall 42 and the apposite side edge 56 of a panel 52 in an end wall 44.

These panels have a side edge length equal to that of the panels 50 and 52.

It is important, in constructing a structure as shown in FIGS. 1–3, that the corner triangles 46 have a base edge to side edge length ratio ($b/l$ in FIG. 3) which is between 0.40 and 0.50. This ratio will preferably be around 0.48 although it will vary depending upon the degree of inclination wanted in side and end walls 42 and 44, for example.

If the maximum ratio of 0.50 is exceeded, the roof becomes so flat as to be overstressed; and, beyond ratios of 0.52, the panels cannot be assembled. The lower of the specified values is that which has been found necessary to enclose maximum areas without imposing unreasonable stresses on the components of the structures.

That the side and end walls meet at exactly right angles is an important attribute of structure 40. Rectangular foundations can in general be more easily and therefore less expensively constructed than those of other shapes. Also, the rectangular plan typically makes it easier to support structures of the type identified by reference character 40 from and otherwise associate them with existing structures.

The roof or cover 48 of building 40 is made up of equilateral triangle panels 64 which are dimensionally like the panels 50 and 52 in side and end walls 42 and 44 and isosceles triangle panels 66 at the four corners of the cover. One equilateral triangle panel 64 is located at each end of the cover, and the remaining panels 64 are arranged in two trapezoidal side walls 68 which meet at a dihedral angle along a rectilinear ridge 70. The base edges 72 of corner panels 66 are equal in length to and edge abutted with the base edges 74 of lower corner panels 46. The side edges 76 of panels 66 are equal in length to and butted with side edges 78 of equilateral triangle roof panels 64.

The base edges of the equilateral triangle panels 64 at the ends of cover 48 and the lower edges of alternate panels in the cover side walls 68 are edge abutted with base edges 80 of side and end wall equilateral triangle panels 50 and 52 as shown in FIGS. 2 and 3. This, together with the similar arrangement of corner panels 46 and 66, results in cover 48 being continuously supported from the side and end walls around its periphery and in there being a continuous joint or seam between the panels around the periphery of building structure 40.

It will be apparent from the foregoing that building 40 includes panels of only two different shapes — panels 50, 52, and 64 are all one shape; and lower and upper corner panels 46 and 66 a second. This exemplifies a common and important advantage of our novel building structures — they can be fabricated from a very small number of dimensionally different panels.

It will also be apparent to those skilled in the relevant arts that cover 48 is by itself a self-supporting structure.

This is important in that the cover can as a consequence be used independently of the illustrated side and end wall structure.

One building structure of the type shown in FIGS. 1–3 is erected from 20 equilateral triangle panels having an edge length of 10.50 feet and eight isosceles triangle panels of the same side edge length and a base edge length of 5.02 feet. The structure is 31.74 feet long and 21.24 feet wide. It has a minimum headroom of 8.91 feet and an overall height of 11.65 feet.

Cover 48 is capable of withstanding dead loads of 3.0 psf and snow and other live loads of 20.0 psf; and the structure can withstand positive and negative wind loads of 20.0 and 9.0 psf, respectively, measured on surfaces parallel to the wind direction.

As shown, building 40 is a completely closed structure. It will be apparent to those to whom this is directed, however, that access to the interior of the structure will normally be provided and that this can be easily done. For example, an access opening can be provided within the confines of any of the triangular panels in side and end walls 42 and 44.

Figure 4:
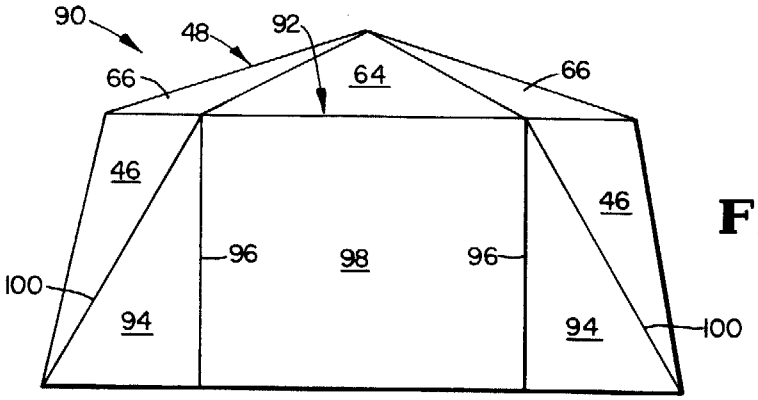
FIG. 4 is a view similar to FIG. 1 of a structure resembling that shown in the latter Figure but having an open side.

Another technique for furnishing access to the interior of a building of the type shown in FIGS. 1–3 is shown in FIG. 4.

The building structure 90 shown in this figure differs from that identified by reference character 40 in that one of the two end walls 92 of the structure is composed of two right angle panels 94 at opposite sides of the structure. These panels have spaced apart vertical edges 96 outlining an opening 98 to the interior of the structure. The inclined side edges 100 of panels 94 are abutted with the triangular corner panels 46 at the end of structure 90 where opening 98 is located. Thus constructed, the structure remains self-supporting and possessed of all of the attributes discussed above except that three rather than two types of panels are required for its fabrication.

Various modifications may of course be made in structure 90. The illustrated arrangement may be employed to associate this structure with a second building structure, for example; and the access opening can be provided in a side rather than end wall of the structure, if desired.

Figure 5:
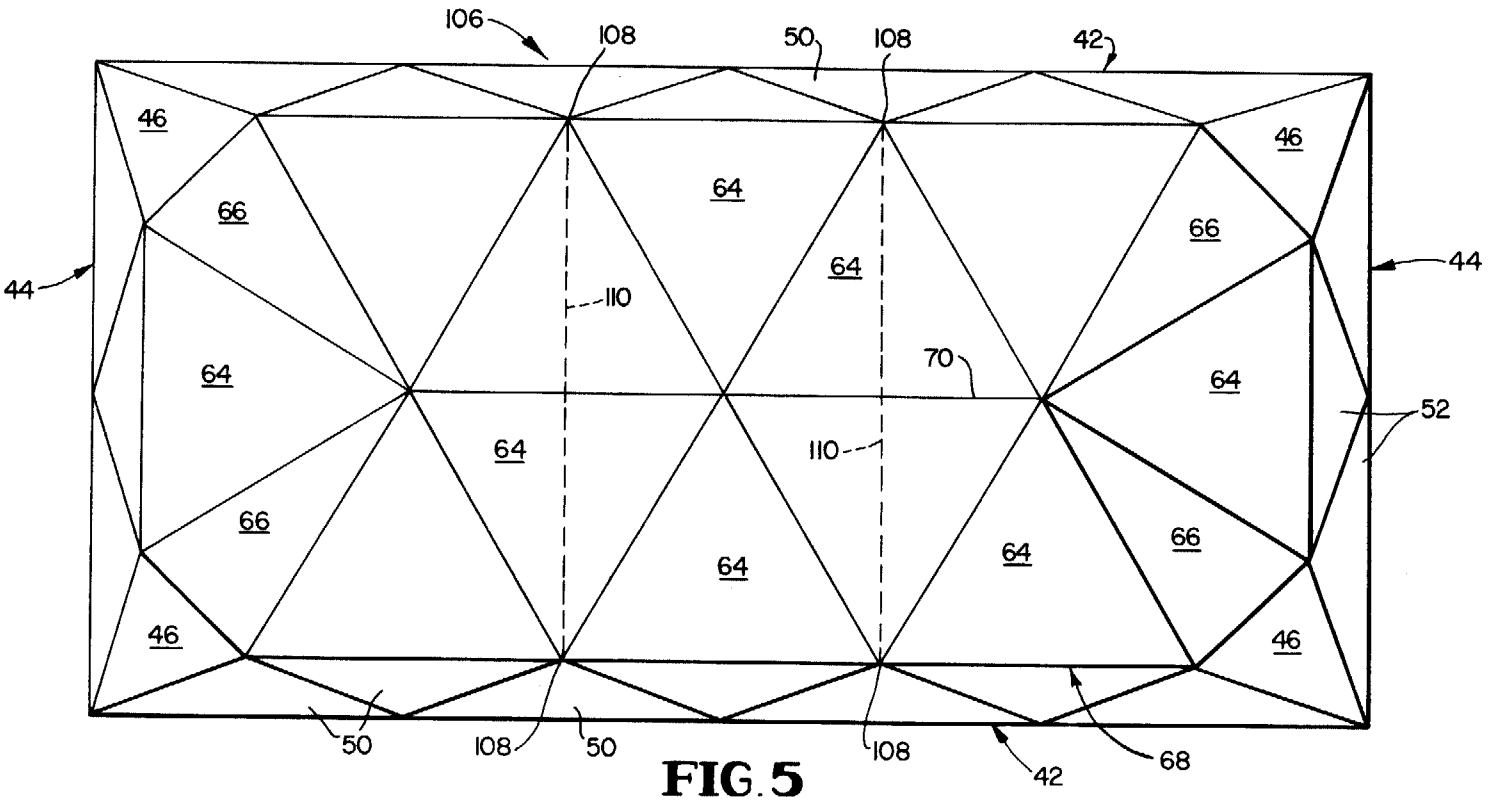
FIG. 5 is a view similar to FIG. 3 of a structure resembling that shown in FIG. 3 but lengthened by the use of tensioned members in accord with the principles of the present invention to embrace a larger area.

As indicated above, the building structure 40 depicted in FIGS. 1–3 is self-supporting in the form in which it is shown. This important advantage can be retained and the length of the building increased to any extent which may be desired by the use of transversely extending tension members. A building embodying this novel principle and constructed in accord with the principles of our invention is shown in FIG. 5 and identified by reference character 106. As this building is primarily a duplicate of that shown in FIGS. 1–3, identical reference characters have been employed to identify like components of the two structures.

In building 106 there are two points or locations 108 on each side of the building where apices of panels 50 in side walls 42 and panels 64 in cover 48 meet and are joined together. One end of a tension member 110, which may be a cable, rod, etc., is connected to the panels at one location 108 in each pair thereof. The other end of the tension member is connected to the panels at the corresponding location at the other side of building structure 106.

Building 106 is longer than the building 40 shown in FIGS. 1–3 by a distance equal to the edge length of the equilateral triangle panels from which it is constructed. This is not a limitation, however; and the length of this type of building can be increased indefinitely by employing tension members 110 between each of the additional pairs of junctions 108 which will result as the length of the building is increased.

Figure 6:
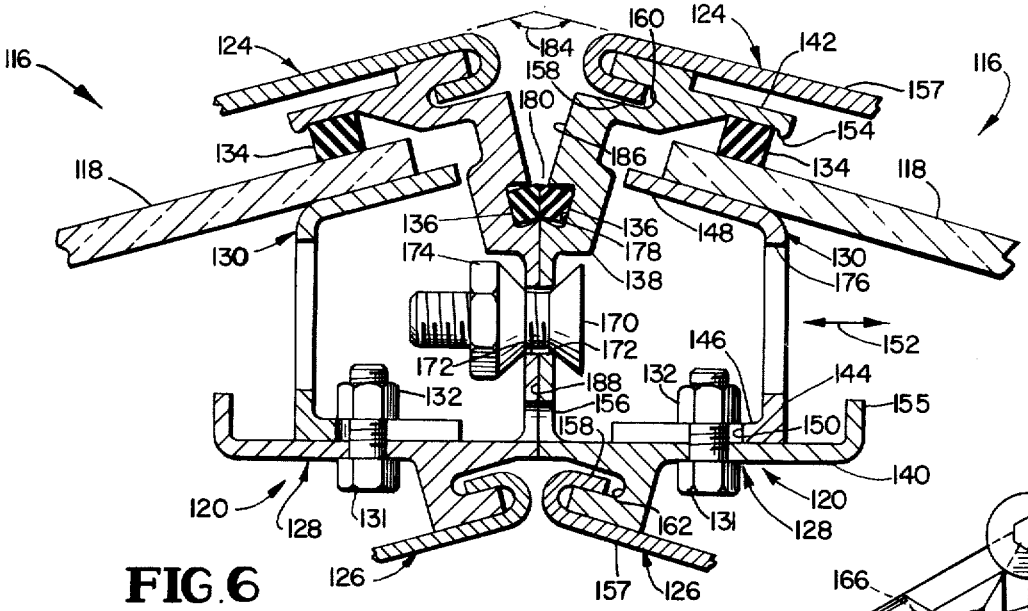
FIG. 6 is a partial section through two adjoining panels embodying the principles of our invention; it shows how the panels are constructed and assembled.

Referring again to the drawing, FIGS. 6–8 show one exemplary type of panel construction in accord with the principles of the present invention from which the building structures we have invented can be fabricated. The triangular panels 116 shown in these figures have a triangular main body member 118, a frame 120 made up of three frame sections 122 (two of which are shown in FIG. 7), and triangular clips 124 and 126 for holding the frame sections 122 together.

The sheet or platelike main body members 118 of the panels can be made of relatively fragile, light transmitting materials such as glass, Plexiglas and other plastics, etc. This permits the building structures we have invented to be used for skylights, greenhouses, and swimming pools and tennis court covers and in other applications where natural illumination of the interior of the structure is wanted.

It is of course not necessary that the main panel members be made of the particular materials just described or, indeed, of light transmitting materials at all. They may be made of wood, metal, or virtually any other structural material.

Furthermore, the main panel members do not have to be of the illustrated platelike configuration throughout. They may be of any cross-sectional configuration which does not interfere with the installation of frame 120 and retaining clips 124 and 126.

Also, the main panel members can be hinged for ventilation purposes, and they can be used to support other components of the building structure such as stacks, vents, etc. A myriad of other modifications will be readily apparent to those to whom this application is directed.

Referring now to FIG. 6, each of the frame sections 122 of the panel includes outer and inner frame members 128 and 130. Outer frame members 128 are mitered together at the corners or apices of the panels, and fasteners 131 and retainers 132 are provided for fastening the inner and outer frame members together. There are also a gasket 134 which furnishes a seal between frame 120 and main panel member 118 and a second gasket 136, which co-operates with a similar gasket or seal in the adjoining panel of an assembled structure to seal the joint therebetween.

Frame members 128 and 130 can be extruded from aluminum and alloys of this and other metals, for example, or formed by other manufacturing techniques. Frame members 128 have a central section 138 and transversely extending legs 140 and 142 at opposite ends of the center section.

Inner frame members 130 are of generally the same configuration as frame members 128. They have a central section or portion 144 and legs 146 and 148.

Each frame member 130 is supported from the leg 140 of the associated frame member 128. Elongated slots 150 in leg 146, through which fasteners 131 extend, allow frame member 130 to be displaced relative to frame member 128 along a rectilinear path as indicated by double-headed arrow 152 in FIG. 6.

Main panel member 118 is supported by the legs 148 of the three panel members 130. Gasket 134, which extends the length of each frame section, is trapped between the main panel member and the leg of the panel member 128. The latter has a depending, integral projection 154 for retaining the gasket in place.

As shown in FIG. 6, the upper legs 148 of frame members 130 are inclined wedges. Consequently, by displacing frame members 130 relative to frame members 128 along path 152, gasket 134 can be compressed between main panel member 118 and the legs of frame members 128 to a degree which will provide optimum sealing between the main panel member and the frame.

A further feature of frame 120 is the provision of flanges 155 extending the lengths of the legs 140 of frame members 128. These flanges convert frame member 128 into gutters for carrying away the condensate which may form on the insides of the building structures into which the panels are assembled. Weep holes 156 in frame member central sections 138 allow the condensate to flow from one panel to the next.

Referring now to both FIGS. 6 and 7, the generally triangular clips 124 and 126 by which the frame sections of the panels 116 are held together will typically be made of sheet metal. They have a main body portion 157 and flanges 158 which are integral with, generally parallel to, and extend toward the center of the clip.

Flanges 158 of clips 124 fit in grooves 160 formed in the upper or outer sides of converging frame members 128 and opening onto the ends thereof. The flanges of clips 126 fit in similar grooves 162 on the lower or inner sides of these members.

Clips 124 and 126 are displaced toward the center of the panel; i.e., in the direction shown by arrow 164 in FIG. 7, to clamp together the mitered ends 166 of the two frame sections 122 with which they are associated. The clips are retained in place by friction and, if desired, by retaining pins 168, the outer one of which is shown in FIG. 7.

Adjacent panels of the character just described are assembled in edge abutting relationship (i.e., with central sections 138 of the frame members 128 of adjacent panels butted) by fasteners 170, which extend through aligned apertures 172 in the frame members, and retainers 174. Access to the fasteners and retainers is afforded by apertures 176 in the central sections 144 of frame members 130.

Fastener, retainer combinations as just described are employed at intervals along the edge abutted frame sections 122. There is nothing critical about the distance between the fasteners. This is simply a function of conventional design criteria.

The gaskets 136 employed to seal the gaps between adjacent panels 116 are housed in recesses 178 opening onto the exterior faces of outer frame member central sections 138. With two panels disposed in edge abutting relationship as shown in FIG. 6, the two seals 136 are compressed against each other, sealing the wedge-shaped gap 180 between the panels.

When assembled into building structures of the type we have invented, the dihedral angle 184 between adjacent, edge abutted panels may vary from somewhat less than 150° (FIG. 6) to 180° (FIG. 8). To accommodate this variation, the central sections 138 of frame members 128 are given a V-shaped configuration; and the recesses 178 in which gaskets 136 are housed are located generally along the intersection between the two relatively inclined outer face portions 186 and 188 of the central frame sections. This insures that the two gaskets 136 of adjacent panels will remain in sealing engagement over the entire range of dihedral angles which may be present in building structure as is apparent from a comparison of FIGS. 6 and 8.

Referring now to FIG. 8, we preferably use tapered or wedge-shaped inserts 190 to make the joints between adjacent panels more rigid where the dihedral angle between adjacent panels is sufficiently large to leave a significant gap 192 between the lower face portions 188 of frame member central sections 138. Wedges 190 are employed at the same locations as fastener, retainer combinations 170, 174 and are secured in place by the latter.

Wedges 190 can be provided in such degrees of taper as may be deemed desirable. Generally, however, wedges with two different degrees of taper are sufficient. Typically, the included angle between the sides 196 of the wedges of one type will be on the order of 15° and those of the second type on the order of 30°.

Also, the wedges will preferably be provided with weep holes 197 matching those in frame members 128 so that condensate can drain from one panel to the next.

In addition to the components so far described, our novel system for assembling panels of the type shown in FIGS. 6–8 into self-supporting building structures includes washerlike gaskets 198 and retainers 200 which may be self-threading. The retainers are employed to fasten the seals over the juxtaposed ends of panels meeting at a common intersection and keep moisture, air, etc. from penetrating through the structure at these intersections.

Figure 10:
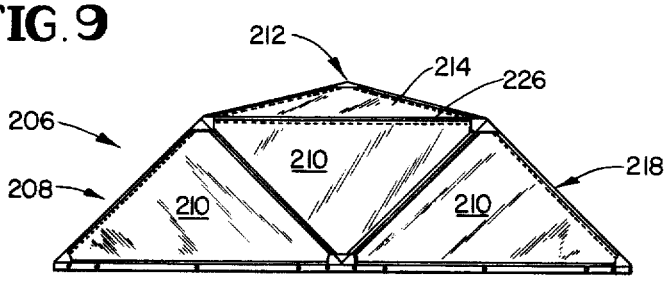
FIG. 10 is an end elevation of the structure shown in FIG. 9.
Figure 11:
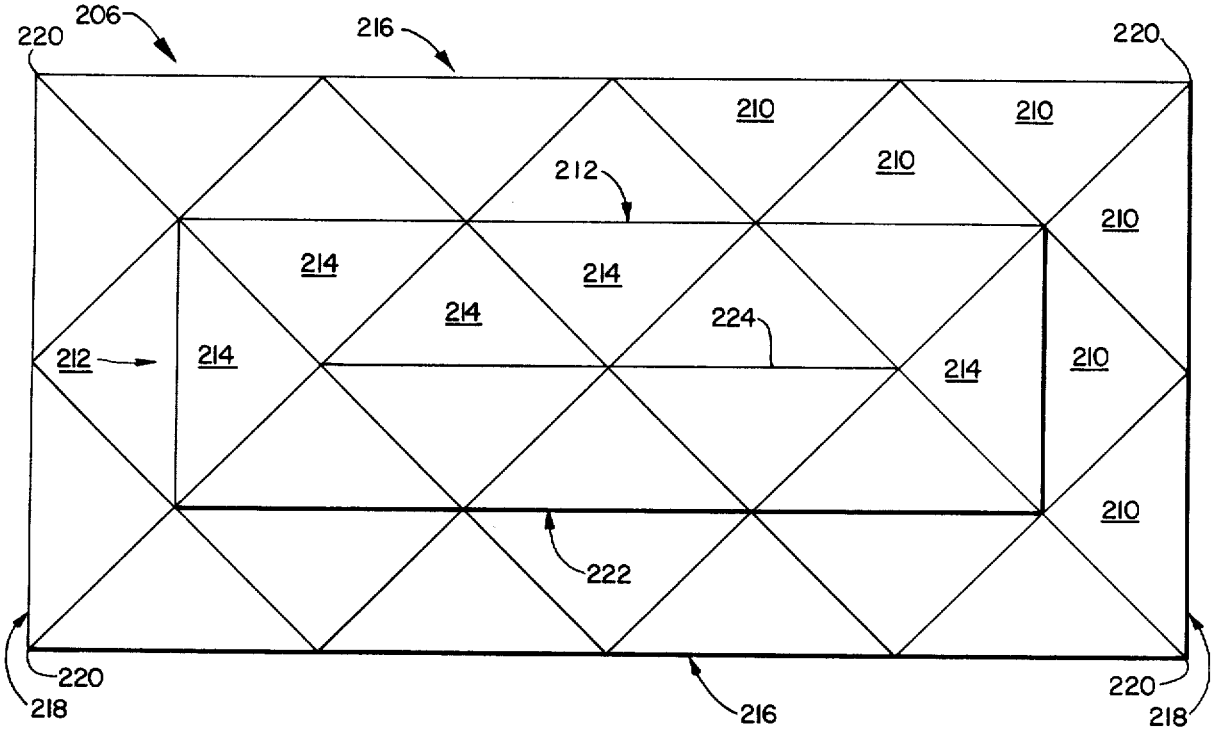
FIG. 11 is a plan view of the structure shown in FIGS. 9 and 10.

Referring again to the drawing, FIGS. 9–11 illustrate yet another building structure 206 which can be constructed from triangular panels of the type just described although it is by no means necessary that this particular type of panel be employed. In fact, virtually any type of panel capable of being assembled in edge abutted relationship can be employed in the construction of building 206 as well as the other building structures disclosed herein.

Building structure 206 differs from that shown in FIGS. 1–3 in that it is assembled from isosceles triangle panels of two different types. Also, it is self-supporting independent of length without tension members.

Building 206 has a lower, side and end wall forming tier 208 of isosceles triangle panels 210 and an upper, cover forming tier 212 of isosceles triangle panels 214. These are $4n$ panels 214 in cover 212 and $4n + 8$ panels 210 in the lower, wall forming tier 208.

Panels 210 and 214 have base edges of the same length. The side edge to base edge length ratio of the panels 210 in lower tier 208 is between 0.80 and 0.90, and the same ratio for the panels 214 in cover 212 is between 0.67 and 0.75.

The panels in the lower tier are assembled in edge abutting relationship into trapezoidally configured side walls 216 (see FIG. 9) and into trapezoidally configured end walls 218 (see FIG. 10). The panels at the ends of the side and end walls meet in edge abutting relationship at the four corners 220 of the structure, which is exactly rectangular in plan.

The ends of cover 212 are each a single panel 214. The remaining upper tier panels 214 are assembled into trapezoidally configured side walls 222 which meet at a dihedral angle and are joined along ridge 224.

Alternate panels are inverted in the side walls of the cover and in the side and end walls of lower tier 208. This forms a continuous lower edge around the periphery of the cover and continuous upper and lower edges around the periphery of tier 208.

Because the base edges of panels 210 and 214 are of the same length, the upper edge 226 of lower tier 208 is equal in length to the lower edge of cover 212. Thus, with the cover supported on lower tier 208, adjacent panels of the lower tier and cover can be assembled in edge abutting relationship with a continuous joint or seam around the periphery of the structure between the two tiers of panels.

As in the case of the building structures described previously, the upper tier or cover 212 is self-supporting by itself. It can be used as a skylight, cover, roof, etc. independently of the lower tier 208 of panels.

One typical building structure of the character just described has 20 lower tier panels 210 with a base edge length of 120 inches and a side edge length of 103.9 inches and 12 upper tier panels with the same base edge length and a side edge length of 86.4 inches. The structure is 20.0 feet wide, 40 feet long, and 6.7 feet high. The height of the structure and cover 212 can be varied by altering the side to base edge length ratio of the triangular panels in the lower and/or upper tiers.

The building structures thus far described have been of single and two-tier construction. This is not an inherent limitation of our invention, however; and building structures constructed in accord with its principles can be made substantially as many tiers high as may be desired for a particular application.

FIGS. 12–14, for example, show a three-tier building structure 234. From one viewpoint, building structure 234 is a two-tier structure as shown in FIGS. 9–11 supported from a third, lower, side and end wall forming tier 236 of isosceles triangle panels 238. For the sake of convenience, building 234 will be viewed as constructed in this manner; and components of the character shown in FIGS. 9–11 will be similarly identified.

Lower tier 236 has $4n + 16$ panels 238. All panels 238 are dimensionally alike, and they have base edges equal in length to those of the panels in the two upper tiers.

Panels 238 are assembled in edge abutting relationship and with their base edges horizontally oriented into trapezoidally configured side wall structures 240 and end wall structures 242, also of trapezoidal configuration. Because of the equal length base edges and the inverting of alternate triangles in the side and end wall structures of the lower tier, it has lower and upper edges extending continuously around its periphery. Accordingly, the panels in tier 236 can be assembled in edge abutting relationship to those in tier 208 with a continuous joint or seam between the two tiers of panels.

It will be obvious to those to whom this application is directed that even higher and/or wider structures can be produced by adding a fourth or fifth or even more tiers of panels to the structure shown in FIGS. 12–14 and that this technique is generally applicable to structures embodying the principles of the present invention.

Figure 15:
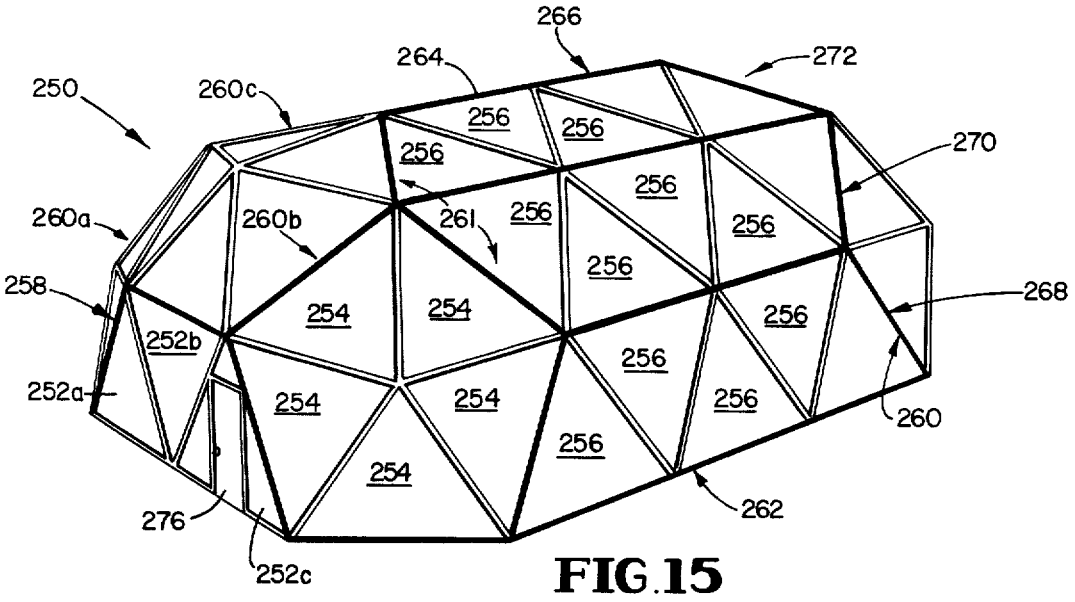

FIG. 15 shows a building structure 250 in accord with the present invention which can typically be employed to advantage where larger areas are to be enclosed. Building 250 is assembled from equilateral triangle panels 252 and isosceles triangle panels 254 and 256 of two different shapes.

Panels 252 are arranged in hemihexagonal arrays 258 at the ends of the structures. There are three pentagonal arrays 260*a–c* of five isosceles triangles 254 at each end of the structure. These co-operate with the hemihexagonal panel arrays 258 to form building structure end sections 261 of a generally hemispherical configuration.

Isosceles triangle panels 256 are assembled into two mirror image related side wall structures 262 extending upwardly and inwardly from opposite sides of the area to be enclosed and meeting in edge assembled relationship along a horizontal ridge 264 to form a vaulted central section 266. Each side wall structure is composed of three vertically superimposed, trapezoidal tiers 268, 270, and 272 of dimensionally alike, edge abutted panels 256.

There are six equilateral triangle panels 252, three at each end of building structure 250.

Thirty isosceles triangle panels 254 are employed. These panels have a base edge length equal to that of the equilateral triangle panels and a side edge to base edge length ratio between 0.86 and 1.0 and preferably around 0.91. The apices of the five panels in each pentagonal array 260 meet at a common point so that the base edges of the panels form the five side edges of the array.

The number of isosceles triangle panels 256 in the central section 266 of the structure is $6 + 12n$. $n$ is a whole number and determines the length of the structure. Building structure 250 is the case where $n$ is 2. Structures of the character just described and shown in FIG. 15 are self-supporting independent on the value of $n$.

The side edge length of panels 256 is the same as the base edge length of panels 252 and 254. Panels 256 have a base edge to side edge length ratio between 1.04 and 1.06. The preferred value is 1.05. These values, as well as those for panels 254, are based on the criteria discussed above in conjunction with the building structure 40 shown in FIGS. 1–3.

Two of the pentagonal arrays of isosceles triangle panels 254 at each end of structure 250 (260*a* and 260*b*) are disposed in edge abutting relationship with: panels 256 in the lower and middle tiers 268 and 270 of wall structures 262, two of the equilateral triangle panels (252*a* and 252*c*), and the third pentagonal panel array 260*c*. The latter is also disposed in edge abutting relationship with the third of the equilateral triangle panels 252*b* and with isosceles triangle panels 256 in the upper tiers 272 of both side wall structures 262.

As do many other building structures embodying the principles of the present invention, that just described lends itself particularly well to panel prefabrication. Furthermore, trapezoidal side wall tiers 268, 270, and 272; the petagonal arrays 260 of panels 254; and the hemihexagonal arrays 258 of equilateral triangle panels 252, for example, can all be assembled prior to reaching the erection site, simplifying and reducing the cost of on-site erection.

Access to larger structures such as that just described can be gained by providing a door 276 in a panel 252*c* or in any other way which may be desired — for example, by employing right triangle panels in one or more sides or ends of the structure in a manner akin to that shown in FIG. 4. These, again, are techniques of general applicability.

One typical application of a structure shown in FIG. 15 is 35 feet wide, 17.5 feet high, and a minimum of 50 feet long. For this relatively large size of building structure, however, only three standardized panels are needed. This is only one-half the number of different panels employed to fabricate the generally comparably shaped structures disclosed in the above-cited Miller U.S. Pat. No. 3,114,176, for example.

Figure 16:
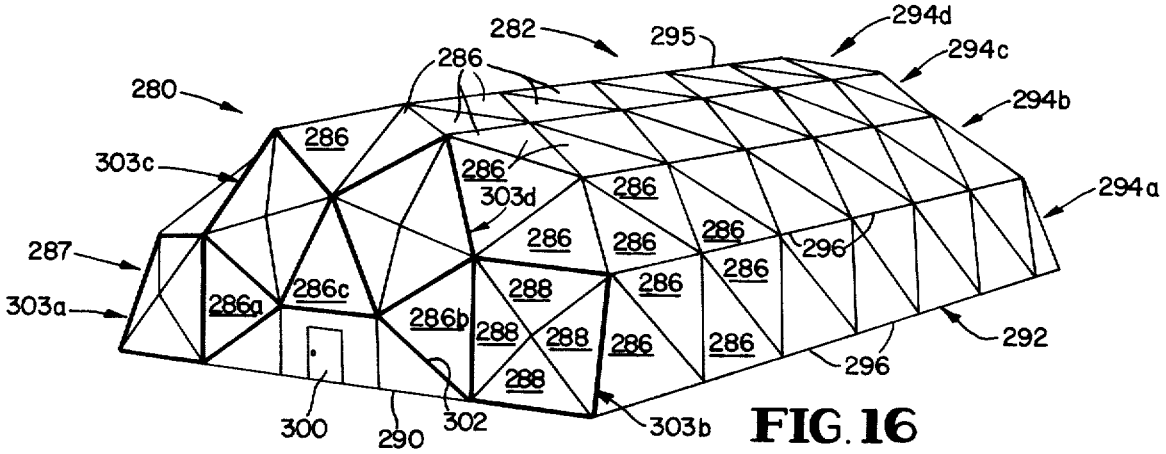

FIG. 16 illustrates a building structure 280 in accord with the principles of the present invention and of a construction which can be employed to advantage in applications where even still larger areas are to be enclosed. Typical dimensions for a structure of this type are: width 60 feet, length 74 feet or more, and height of 17.5 feet.

Building structure 280 has a vaulted central section 282 made up of dimensionally alike equilateral triangle panels 286 and end sections 287 composed of right isosceles triangle panels 288, three additional equilateral triangle panels 286*a–c*, and an end wall structure 290 which, in outline, is a segment of a regular dodecagon.

The equilateral triangle panels 286 of central section 282 are assembled with their base edges horizontal into wall structures 292, each composed of four trapezoidally configured anad mirror image related tiers 294*a–d* of panels. The two wall structures slope upwardly and inwardly from opposite sides of the enclosed space and meet in edge assembled relationship along a horizontal ridge 295 extending down the center of the building structure. Alternate panels 286 in each of the tiers are inverted, and their base edges 296 are oriented horizontally to provide continuous seams or joints between adjacent tiers of panels and along the ridge 295 where the upper edges of panels in the two tiers 294*d* are joined.

The end wall structures 290 at the two ends of building structure 280 can be fabricated in any manner which may be deemed most suitable for a particular application. Doors 300 can be provided in these end structures for access to the interior of building structure 280.

The three sides or edges 302 of structure 290 are equal in length to each other and to the base edges of equilateral triangle panels 286 and isosceles triangle panels 288. The panels 286 and 288 have side edges of the same length.

Sixteen dimensionally isosceles triangle panels 288 are employed at each end of building structure 280. These panels are assembled into four rectangular arrays or panel structures 303*a–d* with their apices at the center of the array. Accordingly, these arrays have sides or edges which are equal in length to the base edges of the triangular panels from which they are assembled.

One of the three equilateral triangle panels 286*a–c* in each end section 287 of building structure 280 is assembled in edge abutting relationship to each of the three edges of the associated end wall structure 290. Rectangular panel structures 303*a* and 303*b* in each end section are each assembled in edge abutting relationship to an equilateral triangle panel 286*a* or 286*b* and to equilateral triangle panels 286 at the ends of the two lower tiers 294*a* and 294*b* in a side wall 292. The other two rectangular arrays 303*c* and 303*d* of isosceles triangle panels are assembled in edge abutting relationship to one of the aforementioned equilateral triangle panels 286*a* and 286*b* and to the third end section equilateral triangle panel 286*c*. Panel structures 303*c* and 303*c* and 303*d* are also each assembled in the same manner to end panels 286 in the two upper tiers 294*c* and 294*d* of a wall structure 292.

Structures of the type shown in FIG. 16 have 30 plus 16*n* equilateral triangle panels 286. Building 280 is the case where *n* (which must be a whole number or zero) equals 5. *n* can be decreased, resulting in a shorter structure, or increased, producing one which is longer. The building structure is self-supporting independent of the value of *n*.

The structure just described, like those discussed previously, readily lends itself to modification. For example, if end structures which are half a dodecagon in configuration are substituted for those identified by reference character 290 above, the number of right isosceles triangle panels increased to 48, and the number of equilateral triangle panels increased to 48 plus 24*n*, a structure which is higher and wider is obtained. The end sections of that structure will in this case approximate one-fourth of a sphere, and the midsection will approximate one-half of a cylinder.

Comparable and further modifications or extensions will provide structures of still other sizes and shapes, all without variation in the traingular panels which are employed.

Figure 17:
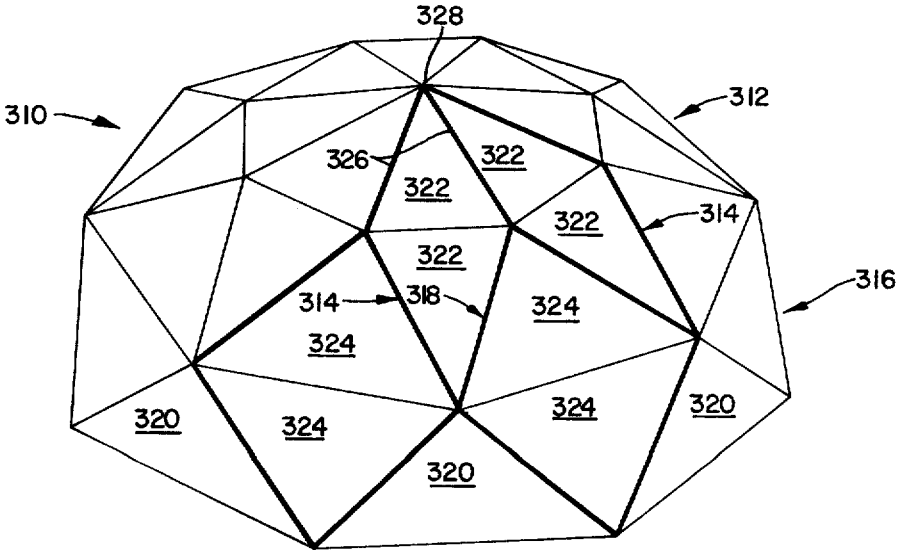

Those building structures so far described are rectangular or essentially rectangular in plan. This again is not an inherent limitation of our invention; its principles can equally well be employed to produce space enclosing structures which are essentially circular in plan. An exemplary structure of this type is illustrated in FIG. 17 and identified by reference character 310.

Building structure 310 has a first or upper tier 312 of eight symmetrical-diamond-shaped panel structures 314, a second or lower tier 316 of also symmetrical-diamond-shaped panel structures 318, and isosceles triangle panels 320.

Panel structures 314 are made up of two isosceles triangle panels 322 assembled in a back-to-back mirror image relationship with their base edges abutting and horizontally oriented in the structure into which they are assembled. Symmetrical-diamond-shaped panel structures 318 are similarly constructed from isosceles triangle panels 324.

Panels 322 are all dimensionally alike as are panels 324. The sides edges of panels 320, 322, and 324 are all of the same length.

Diamond-shaped panel structures 314 are assembled with their upper edge portions 326 in edge abutting relationship and the base edges of the panels from which they are constructed horizontal. The upper apices of the panels meet at a peak 328.

Diamond-shaped panel structures 318 are assembled with their upper panels 324 between and edge abutted with adjacent lower panels 322 of panel structures 314. Panels 320 are assembled between and edge abutted with the lower panels 324 making up panel structures 318. Panels 320 make the surface of the building structures entire and, also, provide a continuous bottom edge around the periphery of the structure.

There is a dihedral angle between the two panels in each of the symmetrical-diamond-shaped structures 314 and 318. This makes building structure 310 slope upwardly and inwardly from the periphery of the area it encloses to peak 328. Depending upon the dihedral angles which are employed and the shapes of the panels making up the symmetrical-diamond-shaped structures, the configuration of the structure can be varied from conical through the generally hemispherical illustrated shape to a frustoconical one in which the upper panels 322 of the symmetrical-diamond-shaped panel structures 314 become horizontal and form a flat roof.

Of particular importance in the construction of structures of the character just described is the use of diamond-shaped panel structures which are symmetrical. Because of this, only three shapes of panels are required to construct the illustrated three-tiered structure, for example. In contrast, in previously proposed circular structures such as that shown in the above-cited Hein U.S. Pat. No. 3,359,694, for example, eight different shapes of triangular panels are required for a three-tiered structure. The advantages of this vast simplification are self-evident.

Figure 18:
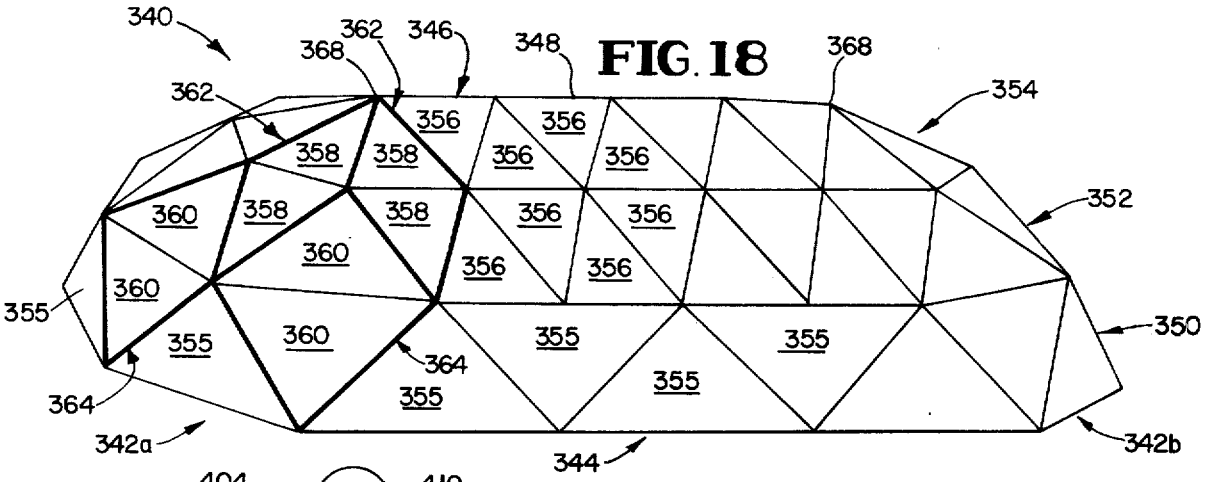

Constructions in accord with the present invention as just described can be utilized to advantage in the erection of elongated as well as circular building structures. FIG. 18, for example, illustrates a building structure 340 having end sections 342*a* and 342*b* constructed in the manner just described in conjunction with building 310 and a vaulted central section 344.

The central section 344 of building structure 340 has the configuration of a segment of a cylinder and is composed of two side wall structures 346 which slope upwardly and inwardly from opposite sides of the area to be enclosed and meet in edge assembled relationship along a horizontal ridge 348. Each of the two wall structures 346 is composed of three, trapezoidal tiers 350, 352, and 354 of triangular panels.

The two upper tiers are of the same configuration but in mirror image relationship.

The panels are lower tier 350 are isosceles triangle panels 355 assembled in edge abutting relationship with alternate panels inverted to form continuous upper and lower edges. The two upper tiers 352 and 354 are both composed of isosceles triangle panels 356 with alternate panels in each of these tiers also being inverted so that the tiers will have continuous upper and lower edges.

The horizontal edge defining panels in each tier are assembled in edge abutting relationship to the corresponding panels in the tier thereabove as in the other building structures described herein.

Each of the two end sections 342*a* and 342*b* has the configuration of the segment of a spheroid and contains isosceles triangle panels 355, isosceles triangle panels 358 (which are dimensionally alike panels 356), and isosceles triangle panels 360. Panels 358 are assembled in base edge-abutted, back-to-back relationship into symmetrical diamond-shaped panel structures 362, and panels 360 are similarly assembled into symmetrical-diamond-shaped panel structures 364.

The upper panels 358 in diamond-shaped structures 362 are assembled in side edge abutting relationship to each other and to end panels 356 in both the middle and upper panel tiers 352 and 354 of the two wall structures 346. The upper apices of panel structures 362 meet in peaks 368 located at the ends of ridge 348.

As in circular building structure 310, the upper panels 360 of lower tier diamond-shaped panel structures 364 are assembled in edge abutting relationship between adjacent lower panels 358 in diamond-shaped panel structures 362. The endmost lower panels 360 in panel structures 364 are assembled in edge abutting relationship to endmost isosceles triangle panels 355 in the lower tiers 350 of side walls 346. The isosceles triange panels 355 in end sections 342*a* and 342*b* are assembled in edge abutted relationship between lower panels 360 in structures 364 to fill the gaps therebetween. This also makes the lower edge of building structure 340 continuous around its periphery.

Many modifications other than those previously identifed may be made in the types of structures discussed in conjunction with FIGS. 17 and 18 without exceeding the scope of the present invention. For example, the upper tier of panels in each of these structures is self-supporting and can, therefore, be used as a roof, cover, skylight, etc. in association with structures of many different types.

Two-tiered structures can also be made employing a single tier of symmetrical-diamond-shaped panel structures and triangular panels to fill the gaps therebetween. These can be used to enclose spaces or in the same manner as single-tier structures.

Figure 19:
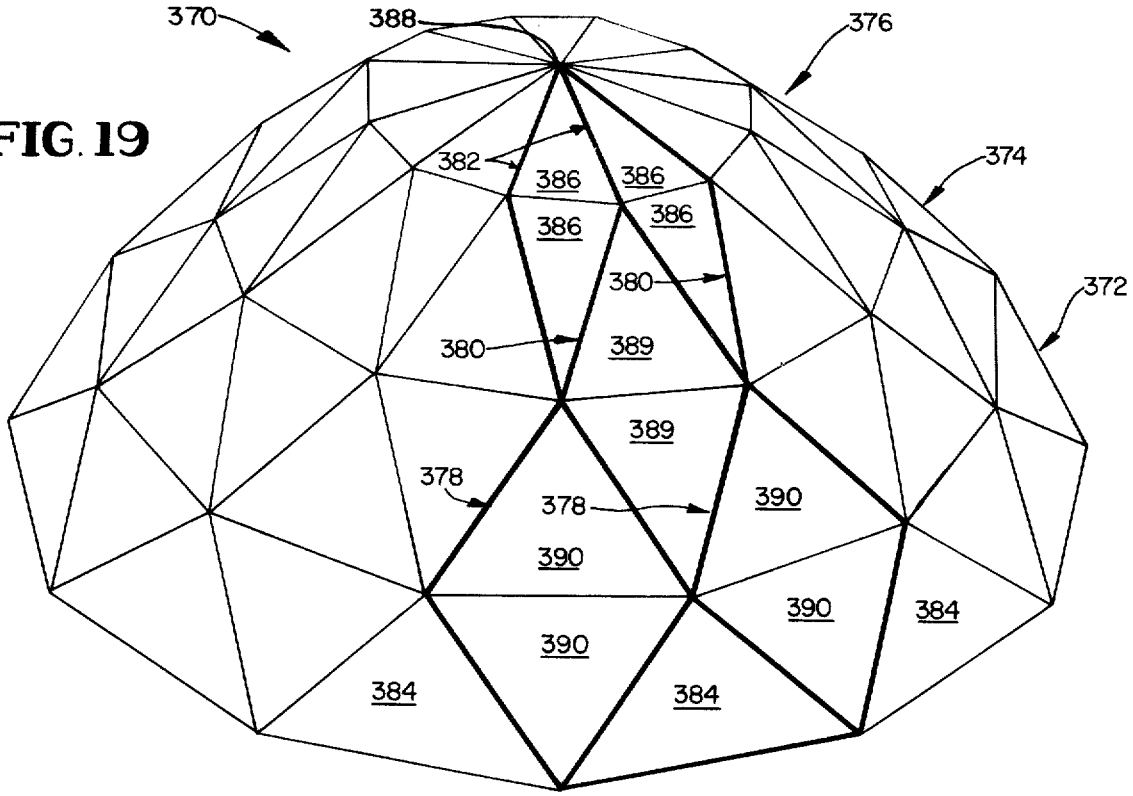

Still other types of structures can be developed by increasing the number of tiers. FIG. 19, for example, shows a circular building structure 370 make up of three tiers 372, 374 and 376 of symmetrical-diamond-shaped panel structures 378, 380, and 382 and isosceles triangle panels 384.

Building structure 370 has twelve rather than eight diamond-shaped structures in each tier thereof. Because of the increased number of tiers and the larger number of diamond-shaped panel structures in each tier, a building structure as shown in FIG. 19 having a diameter of 59 feet and a height of 25 feet can be assembled from panels having a side edge length of only 11 feet.

Building structure 370 is assembled in the manner just described in conjunction with FIGS. 17 and 18; i.e., with the upper panels 386 in the highest tier 376 of diamond-shaped structures 382 assembled in edge abutted relationship about a central peak 388. The upper panels 389 and 390 in the middle and lower tiers 374 and 372 of panel structures 380 and 378 are assembled in edge abutting relationship between the lower panels in the tier thereabove and the isosceles triangle panels 384 between adjacent ones of the diamond-shaped structures 378 in the lowermost tier 372 thereof to make the structure entire and its periphery continuous.

Still other shapes and sizes of circular structures as shown in FIGS. 17 and 19 and elongated structures as shown in FIG. 18 can be obtained by increasing the number of tiers, the shapes of the panels making up the diamond-shaped structures, and the number of such structures in each tier thereof.

It will also be apparent to the reader that structures of the character described with reference to FIGS. 17–19 can be viewed as composed of superimposed tiers of edge abutted isosceles triangle panels and that they can be erected in this manner. Nevertheless, even viewed and/or constructed in this manner the mirror image relationship between the designated panels must be retained to obtain the advantages which our invention is capable of providing.

One type of panel construction from which the building structures of the present invention can be fabricated has been described in conjunction with FIGS. 6–8. Another type of panel which can be employed for our purposes and which is also exemplary of those embodying the principles of our invention is shown in FIG. 20 and identified by reference character 398. This panel, which is of the utmost simplicity, includes a triangular main member 400 surrounded by a compressible peripheral seal 402 (see also FIG. 21) cemented or otherwise fixed to the main panel member. The main member 400 may be of any of the materials suggested above, and several compressible gasket materials which may be employed will readily suggest themselves to the reader.

Panels of the character shown in FIGS. 20 and 21 are assembled in edge abutting relationship by connectors 404 and by tension members 406.

As shown in FIG. 22, each of the connectors 404 consists of an outer, disklike clamp member 408, an inner clamp member 410 of similar configuration, a fastener 412, and a retainer 414. Clamp members 408 and 410 engage the panels meeting at a common intersection on opposite sides thereof. The fastener 412 and retainer 414 bias the two clamping members toward each other to hold the panels engaged therebetween in assembled relationship.

Tension members 406 extend between the inner clamp members 410 of each pair of adjacent connectors and through brackets 416 fixed in any convenient fashion to the clamping members. Retainers 418 at the opposite ends of the tension members secure them in place. By threading these retainers along the tension members or fixtures attached thereto the desired tension in the members can be established.

It is preferred that a constant force spring device be interposed between the retainer 418 and bracket 416 at one (or both) ends of each tension member. This keeps the tension in the members essentially the same despite the differential thermal expansions and contractions which will occur among the various component materials as the ambient temperature changes.

The constant force spring device also simplifies the tensioning of members 406 in the erection process. Such devices typically exert a substantially constant force over a relatively wide range of deflection. Accordingly, if the workman simply tightens the retainer to approximately a mid (or other partial) deflection as determined by visual inspection, the desired amount of tension will be applied to members 406 and maintained despite relatively large dimensional changes.

One suitable form of constant force spring device consists of two Belleville springs 420 and 422 journalled in back-to-back relation on tension member 406 between the associated bracket 416 and retainer 418 at one end thereof. A flat washer 424 can be employed between Belleville spring 420 and retainer 418 to provide a larger bearing surface for the Belleville spring, if necessary.

It will be apparent to the reader that we have above eliminated all reference to those components and features which would be included in an actual building to the extent that a description thereof was not necessary to an understanding of the present invention. This was strictly for the sake of convenience and is not to be taken as implying any limitation in the scope of the appended claims or that such components and features would not be employed in an actual building constructed in accord with the principles of our invention.

It will also be apparent that only exemplary building structures and panel constructions have been described and that many other such structures and constructions can be produced by applying the principles of our invention. Accordingly, to the extent that they are not expressly excluded from the appended claims, all such building structures and panel constructions are fully intended to the embraced therein.

Our invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A structure for enclosing a generally rectangular area, said structure having an elongated, vaulted central section composed of plural tiers of upwardly and inwardly inclined, edge abutted triangular panels, all having one horizontally oriented edge, and end wall means at the ends of the vaulted central section for completing the enclosure of said rectangular area, said end wall means each including a structure configured as a segment of a dodecagon, triangular panels edge abutted to said structure, and rectangular structures edge abutted to panels of said central section and to triangular panels of the end wall means.

2. A structure as defined in claim 1 wherein each of said rectangular structures is composed of four dimensionally alike edge abutted isosceles triangle panels so disposed that their base edges form the four edges of the structure.

3. A structure for enclosing a generally rectangular area, said structure having an elongated central section and end wall means at the ends of the central section for completing the enclosure of said rectangular area, said central section being composed of two four-tiered structures each made up of dimensionally alike, triangular panels, the two structures arching upwardly and inwardly from opposite sides of the area to be enclosed and each of said end wall means including: a structure which, in configuration, is a segment of a regular dodecagon having three exposed edges; dimensionally alike equilateral triangle panels edge abutted to the aforesaid edges of the last-mentioned structure, the base edges of the equilateral triangle panels being the same length as said exposed edges; and four four-member arrays of dimensionally alike, edge abutted isosceles triangle panels oriented with their base edges forming a rectangle, said base edges being equal in length to the base edges of the equilateral triangle panels in the end wall means, two of said four-member arrays each being abutted to an end panel in each of two lower tiers of the central section of the building structure and to one of the equilateral triangle panels in the end wall means and the remaining two four-member arrays each being edge abutted to an end panel in each of two upper tiers of the central section and to two of the equilateral panels in the end wall means.

4. A structure for enclosing a generally rectangular area, said structure having an elongated, vaulted central section which is rectangular in plan and is composed of plural tiers of upwardly and inwardly inclined, edge abutted panels, all of said panels being equilateral panels and said panels having one horizontally oriented edge, and said structure also having end wall means at the ends of the vaulted central section for completing the enclosure of said rectangular area, said end wall means each including panels edge abutted to panels of and located at the ends of said vaulted central section, and said structure being made up of 32 isosceles triangle panels and 30 plus 16*n* equilateral triangular panels,

*n* being zero or a whole number, and said isosceles triangle panels being divided between the end wall means at the opposite ends of the structure.

5. A structure for enclosing a generally rectangular area, said structure having an elongated, vaulted central section which has a rectangular plan and is composed of plural tiers of upwardly and inwardly inclined, edge abutted panels, all of which are equilateral triangle panels oriented with one edge thereof horizontal; said structure further having an end wall means at each of the two ends of the vaulted central section for completing the enclosure of said rectangular area, said end wall means ecah including both equilateral triangle and isosceles triangle panels, each of said isosceles triangle panels being edge abutted to a different one of the isosceles triangle panels in the same end wall means and to an equilateral triangle panel in said end wall means or an equilateral triangle panel in and at the corresponding end of the vaulted central section.

6. A structure for enclosing a generally rectangular area, said structure having an elongated, vauled central section and end wall means at the ends of the vaulted central section for completing the enclosure of said rectangular area, said vaulted central section having two wall structures each composed of four trapezoidally configured and mirror image related tiers of equilateral triangle panels, said wall structures sloping upwardly and inwardly from opposite sides of the enclosed space and the panels in the upper tiers of said wall structures meeting in edge abutted relationship along a horizontal ridge extending down the center of the building structure; and said end wall means each including a combination of equilateral triangle panels and isosceles triangle panels, there being 16 isosceles triangle panels arranged in four rectangular arrays in each of said wall means, at least one of the edges of each said array being abutted to an equilateral triangle panel in the same end wall means and two of the edges of each such array being abutted to panels in said vaulted central section.

* * * * *

UNITED STATES PATENT OFFICE

CERTIFICATE OF CORRECTION

PATENT NO. : 3,945,160
DATED : March 23, 1976
INVENTOR(S) : Christian E. Grosser et al It is certified that error appears in the above-identified patent and that said Letters Patent are hereby corrected as shown below:

Column 1, line 30, delete "31".

Column 1, line 33, change "Apr," to --Apr.--.

Column 5, line 18, change the "period" to a --semi-colon--.

Column 13, line 68, delete "and 303c".

Column 15, line 32, change "are" , first occurrence, to -- in --.

Column 16, line 19, change "make" to --made--.

Column 19, line 13, change "ecah" to --each--.

Column 19, line 21, change "vauled" to --vaulted--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*